US005148970A

United States Patent [19]

Johnston

[11] Patent Number: 5,148,970

[45] Date of Patent: Sep. 22, 1992

[54] TAMPER EVIDENT FOLDING CARTON

[75] Inventor: Alan Johnston, New Haven, Conn.

[73] Assignee: Rexham Corporation, N.C.

[21] Appl. No.: 819,464

[22] Filed: Jan. 10, 1992

[51] Int. Cl.[5] ..... B65D 5/06; B65D /542

[52] U.S. Cl. ..... 229/102; 206/807

[58] Field of Search ..... 229/102, 132; 206/807

[56] References Cited

U.S. PATENT DOCUMENTS 4,475,661 10/1984 Griffin ..... 206/807
4,526,752 7/1985 Perlman et al. ..... 206/807
4,838,708 6/1989 Holcomb et al. ..... 206/807
4,937,040 6/1990 Holcomb et al. ..... 206/807
4,972,953 11/1990 Friedman et al. ..... 229/102
4,998,666 3/1991 Ewan ..... 229/102
5,005,719 4/1991 Phillips et al. ..... 229/102
5,060,848 10/1991 Ewan ..... 229/102

*Primary Examiner*—Gary E. Elkins
*Attorney, Agent, or Firm*—Schweitzer Cornman & Gross

[57] ABSTRACT

A tamper evident folding carton having tamper indicating seals at opposite ends, at least one of which seals will be triggered by an attempted violation of carton integrity through the carton side seam.

2 Claims, 3 Drawing Sheets

TAMPER EVIDENT FOLDING CARTON

BACKGROUND OF THE INVENTION

The present invention is directed generally to the field of tamper evident packaging and more particularly to tamper evident folding cartons of the type having a tamper evidencing "flagging device" or other readily visible indicating device incorporated into the carton closure.

SUMMARY OF THE PRESENT INVENTION

Specifically the present invention is directed to folding cartons in which the "flagging device" or tamper-indicating means is in the nature of a latent message or signal disposed in a window at the carton end which signal appears when the carton is opened. For example the latent message may be the word "opened" or a color change which will appear at the end of the carton in the window when the carton flap has been opened. While the carton is closed and untampered with, the window has an empty colored panel which is visible to a potential user without any message or signal of opening.

Tamper evident labels have been utilized for externally sealing folding cartons and other packages so as to provide some indication of unauthorized opening or tampering. Such labels typically include latent graphics formed on the labeling medium which become visible when the label is opened, disrupted or its integrity compromised.

Certain dramatic improvements in tamper indicating labeling materials and tamper indicating seals have recently been developed by the 3M Company and others. These tamper indicating seals maybe employed in envelopes, security deposit bags, folding cartons, and other containers having overlying closure flaps. Advantageously, the seals, when opened, display a readily visible "flagging" message or signal indicating that the integrity of the sealed carton has been disrupted. The specific structures of such tamper indicating seals are disclosed in U.S. Pat. Nos. 4,937,040 and 4,838,708 owned by Minnesota Mining and Manufacturing Company, St. Paul, Minn. and U.S. Pat. No. 4,998,666 owned by Sealcraft Corporation.

While the recently developed tamper indicating seals have shown great promise and potential utility, their incorporation into a commercial acceptable folding carton construction in a manner which will defeat and inhibit determined tampering has not been accomplished heretofore in a manner which has been acceptable to the Food and Drug Administration (FDA). Previously it has been proposed to insert the new tamper evident seals in opposite ends of a conventional folding carton in which the top and bottom end flaps are folded in the identical sequence to seal the carton. Unfortunately this has permitted tampering to be effected by invasion of the glue lap joint carton after severing glue lap extensions while leaving the tamper evident seals intact. Accordingly, it is to a new and improved sealed end construction of an otherwise conventional folding carton including a tamper evident seal on opposite ends of the carton to which the present invention is specifically directed. The new construction results in one or the other of the seals in opposite ends being triggered by an attempted invasion of the carton through a glued side seal.

For a better understanding of the present invention and a greater appreciation of its many attendant advantages, reference should be made to the accompanying drawings taken in conjunction with the following detailed description.

DETAILED DESCRIPTION OF THE INVENTION

Figure 1:
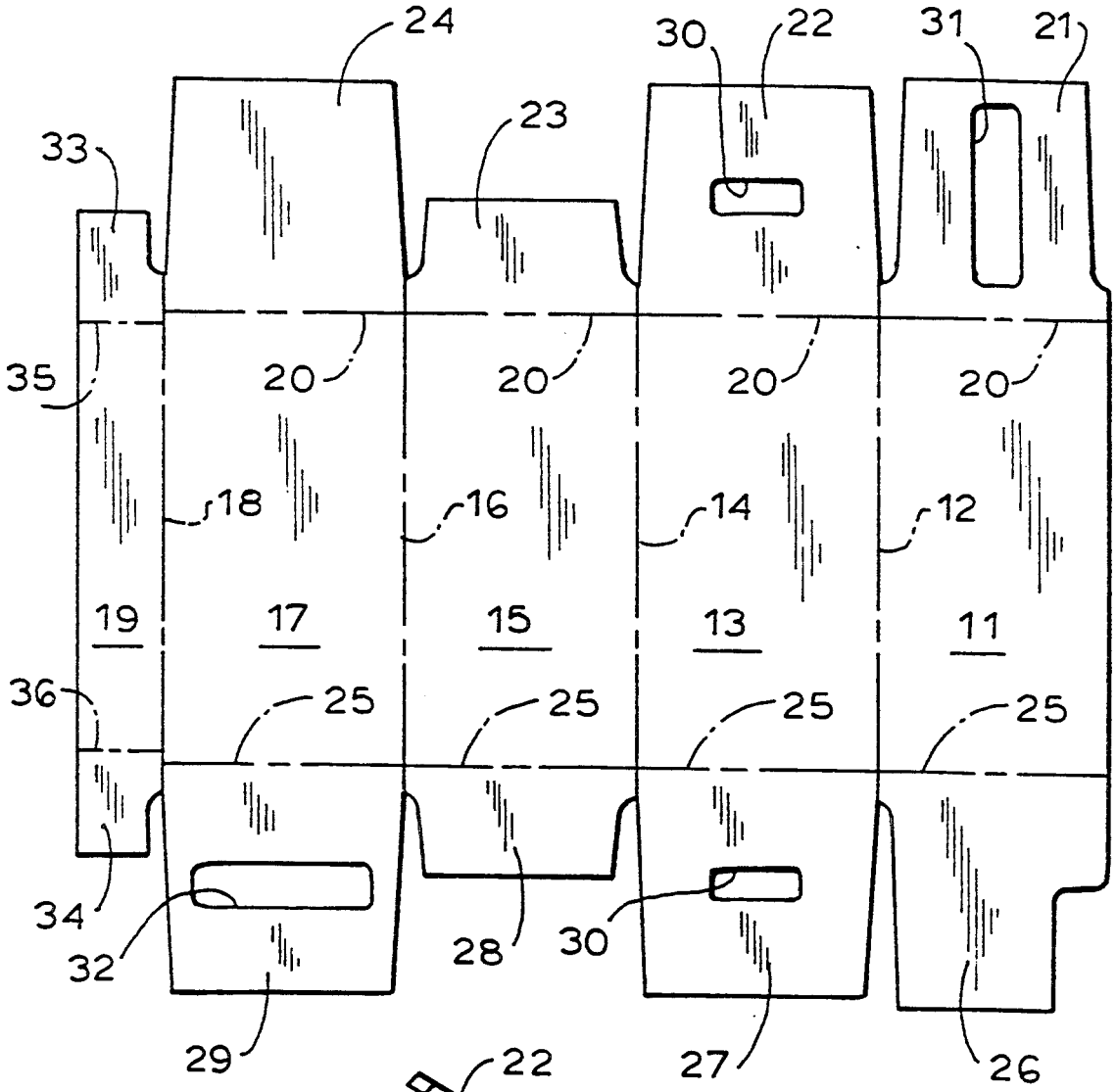
FIG. 1 is a plan view of a folding carton blank from which the new and improved tamper evident folding carton may be erected.

Referring now to FIG. 1, the new and improved carton blank of the present invention includes a first (or side) wall panel 11 articulated along a score line 12 to a second (or front) panel 13 which is in turn articulated along a score line 14 to a third second (or side) wall panel 15 which in turn is articulated along a score line 16 to fourth (or rear) wall panel 17 which is articulated along a score line 18 to a glue lap 19. Articulated to the upper edges of the panels 11,13,15, and 17, along a horizontal score line 20 are a first (side) top flap 21, a second top (front) flap 22, a third top (side) flap 23, and a fourth (rear) top flap 24. Similarly articulated along a horizontal score line 25 to the bottom edges of the carton panels 11,13,15 and 17, are first bottom (side) flap 26, second bottom (front) flap 27, third bottom (side) flap 28, and fourth bottom (rear) flap 29.

In accordance with the principles of the invention a tamper indicating seal 40 (FIG. 2) is superimposed upon a window 30 in the outermost end flap on each end of the carton and the sequence of carton closure of the end flaps is differently ordered at the top and the bottom. To better understand this sequence, the step numbers "1 to 4" corresponding to the folding sequence have been encircled on the respective top and bottom flaps to indicate the order of folding each flap in the sequence of folding. Thus the flaps 22 and 27, which are folded last or fourth, each bear the encircled reference numeral 4, and the flaps 23 and 25, which are folded first, bear the encircled numeral 1. Importantly, in connection with the practice of the present invention, the rear top flap 24 is the second flap to be folded in forming the top closure whereas the bottom rear flap 29 is the third flap to be folded. The final flaps folded in both the top and the bottom end closures are the front flaps 22 and 27, respectively.

More specifically, the flaps 22 and 27 each have a window openings 30 through which the carton sealing adhesive 45 contacts the tamper indicating seals 40 and in which the "flagging" message will ultimately will be visible after the carton is completely erected and then opened. In accordance with the invention, an adhesive receiving slot 31 is formed in the third folded top panel 21 and a similar slot 32 is formed (but arrayed perpendicular to the slot 31) in the third folded bottom flap 29. The glue lap 19 has a top flap extension 33 and bottom flap extension 34. The flaps 33 and 34 are articulated along horizontal score lines 35, 36 which are offset slightly from the parallel score lines 20, 25 in conventional manner to accommodate squaring up of the folded carton tube as will be understood.

In accordance with the invention, a special tamper indicating seal 40 is securely adhered to the outer surface of the top front flap 22 and the bottom front flap 27. As shown best in FIG. 6, the tamper indicating seals 40 are of the general construction disclosed in U.S. Pat. No. 4,998,666 and in U.S. Pat. No. 4,937,040, the disclosures of which patents are incorporated by reference herein.

Figure 6:
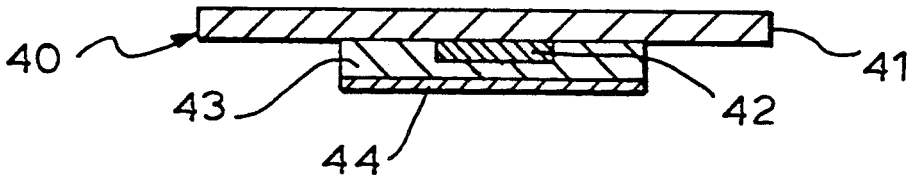
FIG. 6 is a cross-sectional view of a tamper indicating seal.

Referring now to FIG. 6, the tamper indicating seal 40 includes a carrier of transparent or translucent film or paper material 41, e.g., polyester, polyethylene, polypropylene, copolymers thereof or the like. The film 41 is of a size slightly greater than the window openings 30. The film is adhered to the outer surfaces of the flaps 22 and 27 by an adhesive (not shown) which securely fastens the tamper indicating seal 40 to the outer surface of those flaps. On the same side of the film 41 in registry with the window portion 30 is a transparent masking material 42 which forms a printed pattern for the word "opened" or whatever other expression or signaling of carton opening is chosen. The masking pattern 42 is coated with a primer 43 which in turn is coated with a colorant 44. In accordance with the teachings of the aforementioned U.S. Pat. Nos. 4,937,040 and 4,998,666 the primer 43 facilitates adhesion of the colorant layer 44 to the film 41 in those areas in which the masking material 42 is not present. However, when the colorant has a high affinity for the film material 41 of the primer 43 may not be necessary.

Figure 5:
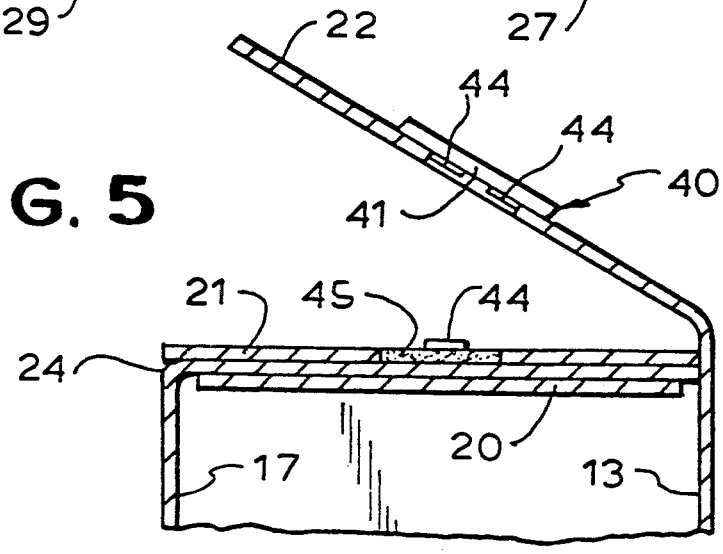
FIG. 5 is a cross-sectional view showing the opened carton end with the tamper evidencing seal triggered to provide a message.
Figure 2:
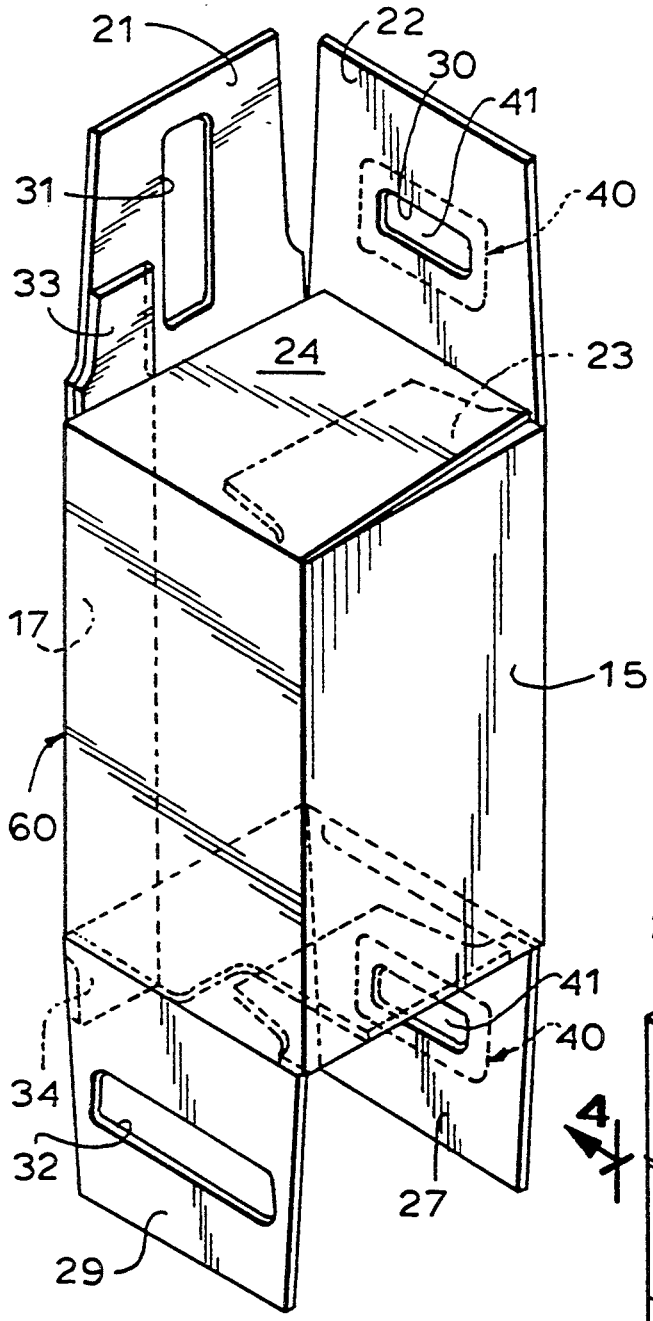
FIG. 2 is a perspective view of a carton blank which has been folded, glued into a carton tube, and squared prior to completion of carton erection by the special sequential folding and sealing of the end flaps.
Figure 3:
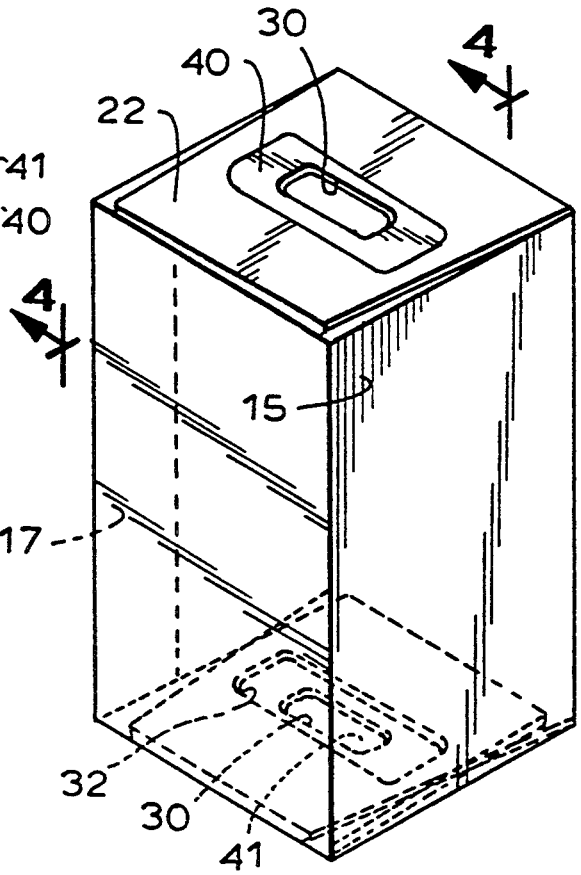
FIG. 3 is a perspective view of a folded and sealed carton embodying the principles of the invention.
Figure 4:
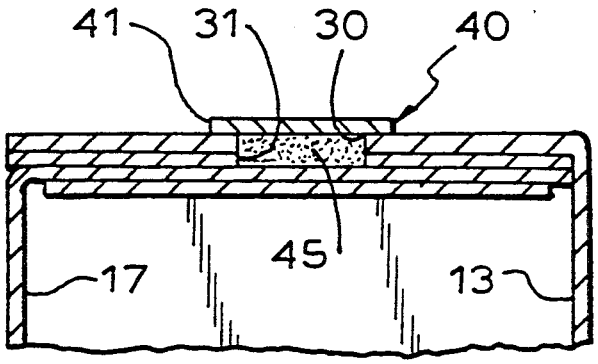
FIG. 4 is a cross-sectional view taken along line 4—4 of FIG. 3.

The new and improved parallelpiped carton 60 of the present invention is erected with tamper evident opening features incorporated at its opposite ends by initially forming a flat-folded carton tube by adhering the glue lap 19 to the first side panel 11 and by adhering the extended glue lap flaps 33, 34 to the end flaps 21 and 26 in conventional fashion. The carton tube is subsequently squared, as shown in FIG. 2, so that the front and rear walls are parallel and the side walls are parallel. Thereafter, in accordance with the principles of the invention, the top end of the carton 60 is closed by first folding the dust flap 23, thereafter folding the rear top flap 24, and then folding the side flap 21 with the adhered dust flap panel 33. In accordance with the invention, a slug of carton closing and sealing adhesive 45 is precisely deposited through the adhesive slot opening 31, and, thereafter, the top front panel 22 is folded down upon the flap 21 and securely adhered to it and the underlying panel 24. It will be understood that the adhesive 45 covers and adheres to the colorant layer 44 of the tamper evident seal 40 which is coated over the transparent masking material 42. Thus upon the unsealing of the flap 22 from the underlying flap 21 the adhesive 45 will selectively dislodge portions of the colorant layer in the area of masking 42 from the tamper evidencing seal 40 and will retain those dislodged portions on the deposited adhesive which is adhered to the flap 24 and is exposed through the adhesive slot 31 as shown in FIG. 5. The "flagging" indicator i.e., the word "opened" will be formed at the removal of colorant in the area of masking on the film 41 and thus the word "opened" will be visible through the film 41 at the window 30 on the flap 22 and the word "opened" (in reverse printing from that in the window) will also appear on the slug of adhesive 45 by virtue of the selective transfer of the colorant layer to the adhesive 45. This is due to the fact that the masking material 42 possesses low adhesion properties with respect to the transparent or translucent film 41 and differential adhesion will occur. Portions of the colorant layer 44 remain on the film and are visible at the window 30 while dislodged colorant portions remain on the adhesive on the underlying flap. The chosen pattern of the masking material will determine the appearance or wording of the tamper evident symbol which becomes visible upon the dislodging of the colorant. As discussed hereinabove, this type of tamper evidencing seal is disclosed in detail in U.S. Pat. Nos. 4,998,666 and 4,937,040, the disclosures of which are incorporated herein by reference.

In accordance with the principles of the invention, while the bottom end of the new carton is sealed with the same tamper evident seal 40 as the top end, the sequence of flap closure is changed (in comparison with the top end) so that flap 28 is first folded and then flap 26 is superimposed thereon. Thereafter the rear bottom flap 32 with the adhered flap 34 is folded and the adhesive slug 45 is deposited into the opening 32 after which the front bottom flap 27 is folded and the bottom carton seal is completed. In accordance with the invention, the glue lap extension flap 34 is thus the second folded flap (along with flap 26 to which it is adhered) in the bottom end but the flap 33 is the third-folded flap (along with flap 31 to which it is adhered) in the top end of the carton (indeed with this sequence the flap 33 may be omitted if desired). This reduces the vulnerability to tampering of the finished carton through the side seam formed by adhering the glue lap 19 and extension flaps 33, 34 to the side panel 11 and its contiguous flaps 21, 26 in the aforementioned sequences.. If one were to attempt to tamper with this seam, then either the panel 21 which is third folded in the top end of the carton or the flap 29 which is third folded in the bottom end will be sufficiently disturbed so as to trigger the tamper evident seals 40 in one or the other of the top or the bottom ends of the carton. This represents a significant improvement over earlier "standard" cartons and is in contrast to proposed "standard" cartons in which the end flap folding sequences of both the top and bottom ends of the cartons were identical and adhesive slots 31, 32 were both formed in the same portions of the carton i.e., both on the rear flaps. However, by having the adhesive slots 31, 32 now formed in flaps attached to different panels in the carton and changing the sequence of folding of the top flaps in comparison to the bottom flaps, an improved folding carton is formed, which carton is effectively resistant to end seam tampering which might otherwise have heretofore gone undetected.

While the present invention has been described with reference to a particular preferred embodiment, it should be appreciated that certain variations and modifications may be made by those skilled in the art. Accordingly, the invention is to be limited only as set forth in the appended claims.

I claim:

1. A tamper-evident folding carton having (a) first, second, third, and fourth walls three of which are articulated to one another along parallel score lines, the fourth of which is adhered to the first by a glue lap articulated to the fourth wall;

(b) top and bottom end closing flaps articulated to the top and bottom of each said first, second, third, and fourth walls;

(c) a glue lap extension flap articulated to at least one of the top and bottom edges of said glue lap;

(d) said glue lap extension flap is adhered to an adjacent closing flap of said first wall;

(e) elongated viewing windows formed in the top and bottom flaps of said second panel;

(f) elongated adhesive closure slots formed in the top flap of said first panel and in the bottom flap of said fourth panel; said adhesive closure slots are adapted to underlie said viewing windows in registry therewith;

(g) the top end of said carton being closed by the sequential infolding of said third top flap; said fourth top flap; said first top flap having said adhesive slot; and said second top flap having said window;

(h) the bottom end of said carton being closed by the sequential infolding of said third bottom flap, said first bottom flap, said fourth bottom flap having said adhesive slot, and said second bottom flap having said window;

(i) adhesive closure means deposited in the form of a slug in said closure slots and adhering said windowed flaps to both said immediately underlying slotted flaps and to the end flaps underlying said slotted flaps; and (j) tamper indicating seals adhered to said windowed flaps and closing off said windows; said seals including a carrier having tamper indicating means of low adhesion material adapted to create an irreversible "flagging" indicia viewable through said carrier at said window when said adhesive closure means sealing said windowed flaps to said underlying flaps has been disrupted by carton-opening or tampering motion.

2. The folding carton of claim 1 in which (a) said seals are applied to the outer surfaces of said carton and closing flaps.

* * * * *